US010428605B2

(12) United States Patent
Fournet et al.

(10) Patent No.: US 10,428,605 B2
(45) Date of Patent: Oct. 1, 2019

(54) UNIVERSAL INJECTION HEAD SYSTEM AND METHOD

(71) Applicant: Integral Oilfield Solutions, Houston, TX (US)

(72) Inventors: Richard Fournet, Lafayette, LA (US); Mohammed Jabbar, Sugar Land, TX (US)

(73) Assignee: Integral Oilfield Solutions, LLC, Houston, TX (US)

( * ) Notice: Subject to any disclaimer, the term of this patent is extended or adjusted under 35 U.S.C. 154(b) by 360 days.

(21) Appl. No.: 15/387,523

(22) Filed: Dec. 21, 2016

(65) Prior Publication Data

US 2017/0175456 A1 Jun. 22, 2017

Related U.S. Application Data

(60) Provisional application No. 62/270,346, filed on Dec. 21, 2015.

(51) Int. Cl.
*E21B 19/22* (2006.01)

(52) U.S. Cl.
CPC ..... *E21B 19/22* (2013.01)

(58) Field of Classification Search
CPC ..... E21B 15/00; E21B 15/02; E21B 17/085; E21B 19/004; E21B 19/086; E21B 19/10; E21B 19/22; E21B 19/24
See application file for complete search history.

(56) References Cited

U.S. PATENT DOCUMENTS 6,158,516 A * 12/2000 Smith ..... E21B 3/045 166/385
6,260,625 B1 * 7/2001 Phan ..... E21B 19/004 166/241.6
6,412,560 B1 * 7/2002 Bernat ..... E21B 19/07 166/104
6,681,894 B1 * 1/2004 Fanguy ..... E04G 1/36 182/113
6,929,071 B2 * 8/2005 Moncus ..... E21B 19/006 166/355
7,036,578 B2 * 5/2006 Austbo ..... E21B 19/22 166/77.2
7,163,061 B2 * 1/2007 Moncus ..... E21B 19/22 114/264
8,322,436 B2 * 12/2012 Maa ..... E21B 19/002 166/338

(Continued)

FOREIGN PATENT DOCUMENTS

WO WO-2009135201 A2 * 11/2009 ..... B23P 19/069

*Primary Examiner* — Jennifer H Gay
(74) *Attorney, Agent, or Firm* — Locke Lord LLP

(57) ABSTRACT

An injector head adapter can include a frame member adapted to couple to an injector head table, an opening in the frame member, a plurality of locator arms coupled to the frame member, each locator arm having a slot, a plurality of pins comprising a pin engaged with the slot of each locator arm, and a plurality of lock nuts comprising a lock nut coupled with each of the plurality of pins. A pin can be adapted to couple to a slot at one or more locations relative to the opening. An injector head system can include an injector head platform, an injector head table, which can be movable, and an injector head adapter.

17 Claims, 9 Drawing Sheets

(56) References Cited

U.S. PATENT DOCUMENTS 8,640,767 B2 * 2/2014 Tucken ..... E21B 19/00 166/381
9,574,411 B2 * 2/2017 Behrens ..... E21B 19/22
9,587,450 B2 * 3/2017 Behrens ..... E21B 19/22
9,677,345 B2 * 6/2017 Miller, Jr. ..... E21B 15/003
2004/0211555 A1 * 10/2004 Austbo ..... E21B 19/22 166/77.2
2005/0129464 A1 * 6/2005 Moncus ..... E21B 19/006 405/203
2005/0199400 A1 * 9/2005 Moncus ..... E21B 19/22 166/355
2006/0048933 A1 * 3/2006 Van Way ..... E21B 19/22 166/77.2
2006/0266511 A1 * 11/2006 Wood ..... E21B 15/006 166/75.14
2010/0326666 A1 * 12/2010 Maa ..... E21B 19/002 166/344
2011/0220344 A1 * 9/2011 Angelle ..... E21B 19/07 166/77.53
2012/0172072 A1 * 7/2012 Baxter ..... E21B 17/01 455/500
2013/0145718 A1 * 6/2013 Bryant, Jr. ..... E21B 15/00 52/650.3
2015/0075803 A1 * 3/2015 Remedio ..... E21B 19/002 166/351
2015/0090464 A1 * 4/2015 Johnston ..... E21B 19/002 166/385
2015/0152693 A1 * 6/2015 DeBerry ..... E21B 19/165 166/344
2015/0152694 A1 * 6/2015 DeBerry ..... E21B 19/165 166/344
2015/0152698 A1 * 6/2015 DeBerry ..... E21B 17/085 166/344
2016/0040488 A1 * 2/2016 Behrens ..... E21B 19/22 166/77.2
2016/0040489 A1 * 2/2016 Behrens ..... E21B 19/22 166/381
2016/0076311 A1 * 3/2016 Placer ..... E21B 41/00 166/355
2016/0084065 A1 * 3/2016 DeBerry ..... E21B 17/085 166/336
2016/0084066 A1 * 3/2016 DeBerry ..... E21B 17/085 166/336
2016/0348448 A1 * 12/2016 Miller, Jr. ..... E21B 15/003
2017/0175456 A1 * 6/2017 Fournet ..... E21B 19/22

* cited by examiner

UNIVERSAL INJECTION HEAD SYSTEM AND METHOD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to oilfield equipment and processes. More specifically, the disclosure relates to equipment and processes used for placing tubing in and out of a subterranean oil or gas well.

Description of the Related Art

The search for hydrocarbons of oil and gas routinely includes use of platforms on which the drilling and production equipment are placed. For remote locations, such as offshore locations, the platform often includes crew quarters and support facilities. Operations from the platform can include drilling the initial bore for a well and casing it, installation of production tubing and well head equipment, follow up efforts to drill additional wells, production of the well, and periodic intervention work on existing wells to assist in production and sometimes to shut down the well. Floor space is limited and so some equipment can be elevated to leave a smaller footprint at the working surface. A lift frame can be used in the field to elevate such equipment and to handle maneuvering of tubing that is inserted into the wellbore. In many of these operations, pipe and other tubing can be inserted into or pulled from the wellbore using a coiled tubing unit with an injector head. The injector head can be specially designed to grip the coiled tubing with a drive system that provides the tractive effort for inserting and retrieving the tubing from the wellbore. The injector head is typically attached to the platform through the lift frame. With the variations in injector heads of different sizes or from different manufacturers, injector head adapters can be used for the variations. Each injector head adapter represents an expense that is only needed because of the variations. A company in the rental business may have to have dozens of adapters for coiled tubing units with differing injector heads, which can call for a significant investment in adapters, such as of $100,000 to $150,000, or more.

There remains a need to simplify the adapters needed for the variations in injector heads, and to reduce expenditures that heretofore have been perceived as required by at least some in the industry.

BRIEF SUMMARY OF THE INVENTION

The present disclosure provides a universal injector head system and method that provides a simplified approach to injector head adapters that has heretofore not been known or used in the industry. Embodiments of the present disclosure can provide an adapter suitable for a variety of injector head sizes and shapes. In at least one embodiment, a universal adapter of the present disclosure can rotate about a central axis for accommodating positioning of the adapter relative to one or more injector heads to be coupled therewith.

INAB, a universal injector head system for an oilfield well can include an injector head platform having an assembly of frame members and at least one lift coupled to the platform, an injector head table coupled to the injector head platform and the lift, the table being movable in elevation relative to the platform by the lift, and an injector head adapter coupled to the injector head table. The injector head adapter can include a frame member, an opening in the frame member, at least one locator arm coupled to the frame member, wherein the locator arm can have a slot or other opening formed in a surface of the locator arm, a locking pin or other structure for engaging or otherwise coupling with the opening, and a locking nut or other coupler coupled with the pin for fixedly or otherwise coupling the pin to the slot of the locator arm.

INAB, a system can include an injector head platform, an injector head table supported relative to the injector head platform, a lift coupled to the injector head platform and the injector head table, an injector head adapter coupled to the injector head table, at least one locator arm coupled to the injector head adapter, a locking pin coupled to the locator arm, and a locking nut coupled to the locking pin.

INAB, a method of coupling an injector head to an injector head system can include placing the injector head on an injector head adapter and optionally rotating the injector head adapter relative to the injector head, such as for aligning the injector head adapter with the injector head. A method can include adjusting a first pin location relative to a first locator arm, such as for fitting an injector head on an injector head adapter and optionally adjusting a second pin location relative to a second locator arm, such as for fitting the injector head adapter, tightening the first pin with a first nut and optionally the second pin with a second nut, such as for fixing a location of the first pin relative to the first locator arm and optionally a location of the second pin relative to the second locator arm. A method can include securing or otherwise coupling an injector head to an injector head adapter. INAB, a method can include removing an injector head and installing another injector head, such as a differently shaped injector head, such as by adjusting a location of at least one pin, which, INAB, can be done without removal of an injector head adapter.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are employed in the written description for clarity in specific reference to the Figures and are not intended to limit the scope of the invention or the appended claims. Where appropriate, one or more elements may have been labeled with an "A" or "B" to designate various members of a given class of an element. When referring generally to such elements, the number without the letter can be used. Further, such designations do not limit the number of members that can be used for that function. As used in this application, the terms "about" and "approximately" are used as equivalents. Any values used in this application with or without about/approximately are meant to include any normal fluctuations appreciated by one of ordinary skill in the relevant art.

The present disclosure provides universal injector head systems and methods for a simplified approach to adapters for a variety of injector head sizes and shapes. INAB, a universal adapter can rotate about an axis, such as a central or other axis, for accommodating positioning of the adapter relative to one or more injector heads that can be coupled to the adapter The Figures are described in conjunction with one another.

Figure 1:
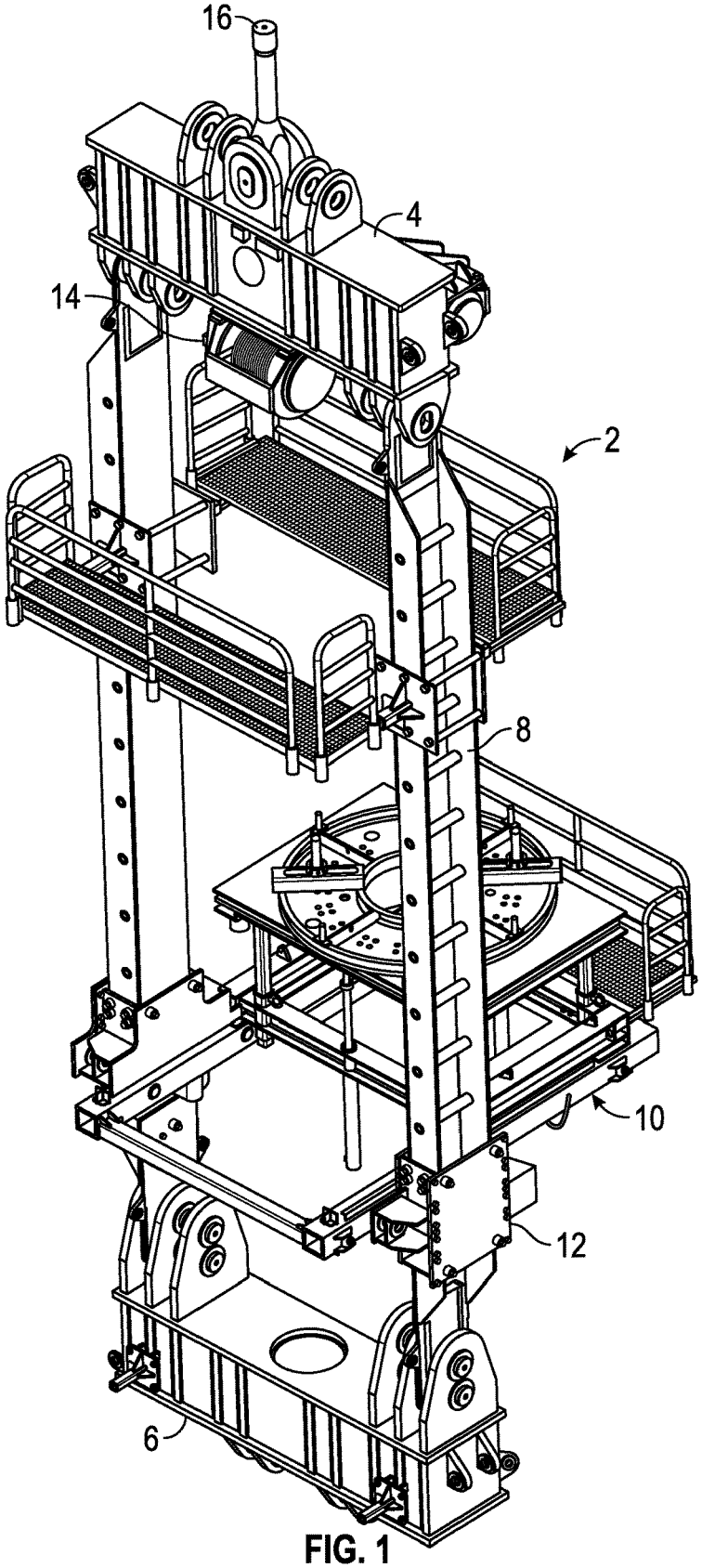
FIG. 1 is a schematic perspective rear view of a lift frame with one of many embodiments of an injector head system according to the disclosure.
Figure 2:
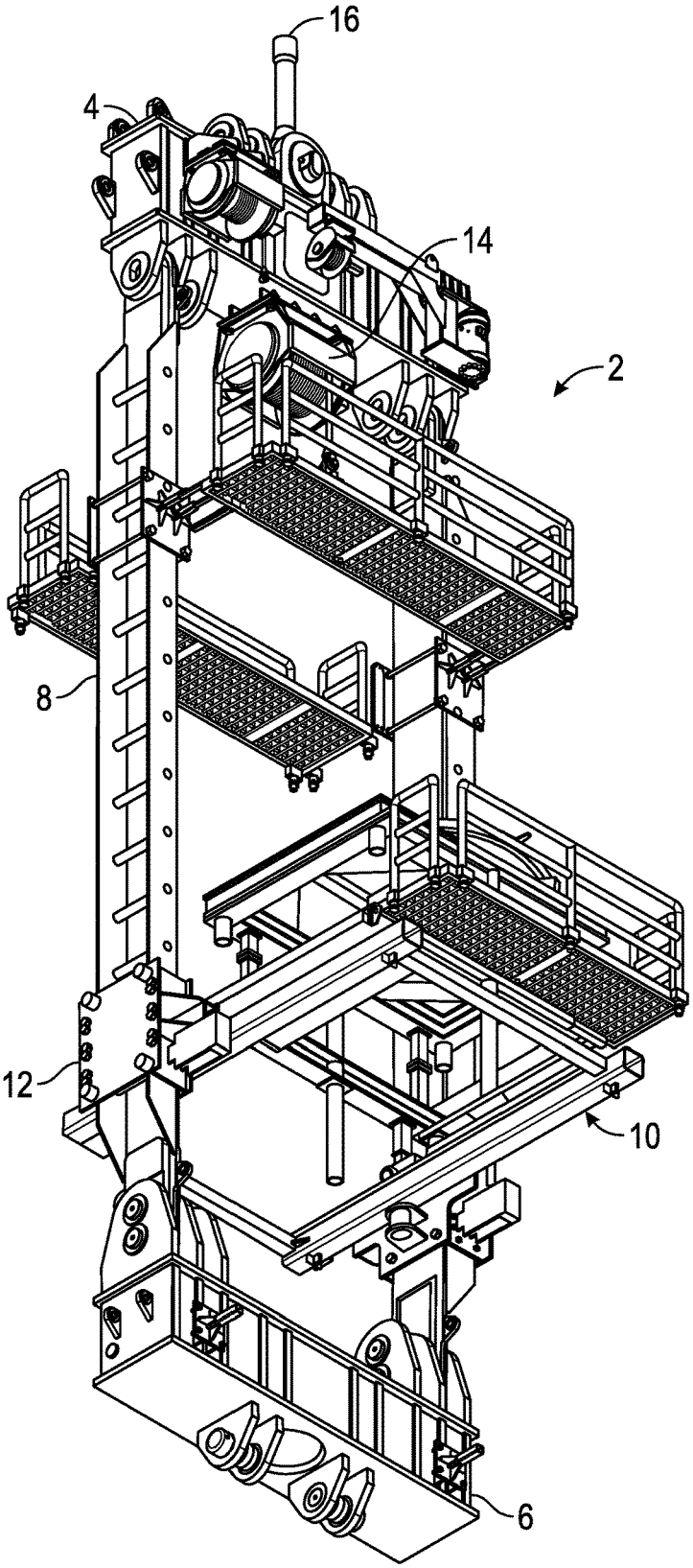
FIG. 2 is a schematic perspective front view of the lift frame with the exemplary injector head system of FIG. 1.

FIG. 1 is a schematic perspective rear view of a lift frame with an exemplary injector head system of the invention. FIG. 2 is a schematic perspective front view of the lift frame with the exemplary injector head system of FIG. 1. A lift frame 2 can be used to support various equipment, including one or more injector heads (not shown) of various designs, shapes, and sizes, for injecting or moving tubing relative to a wellbore. Lift frame 2 can include a first spreader 4, for example at or near a top end of the frame, and a second spreader 6, for example at or near a bottom end of the frame, and one or more columns 8 there between. One of many embodiments of a universal injector head system 10 according to the disclosure is shown coupled to lift frame 2 with couplers 12. The columns 8 can be configured with indexing stops to allow the couplers 12 to be moved to various heights or other positions and coupled or recoupled along the columns. A winch 14 can be coupled to the first spreader 4 to facilitate lifting and lowering of objects in or through the lift frame 2. A lift sub 16 can be disposed on a top end of the lift frame for facilitating moving the lift frame into position or location for use.

Figure 3A:
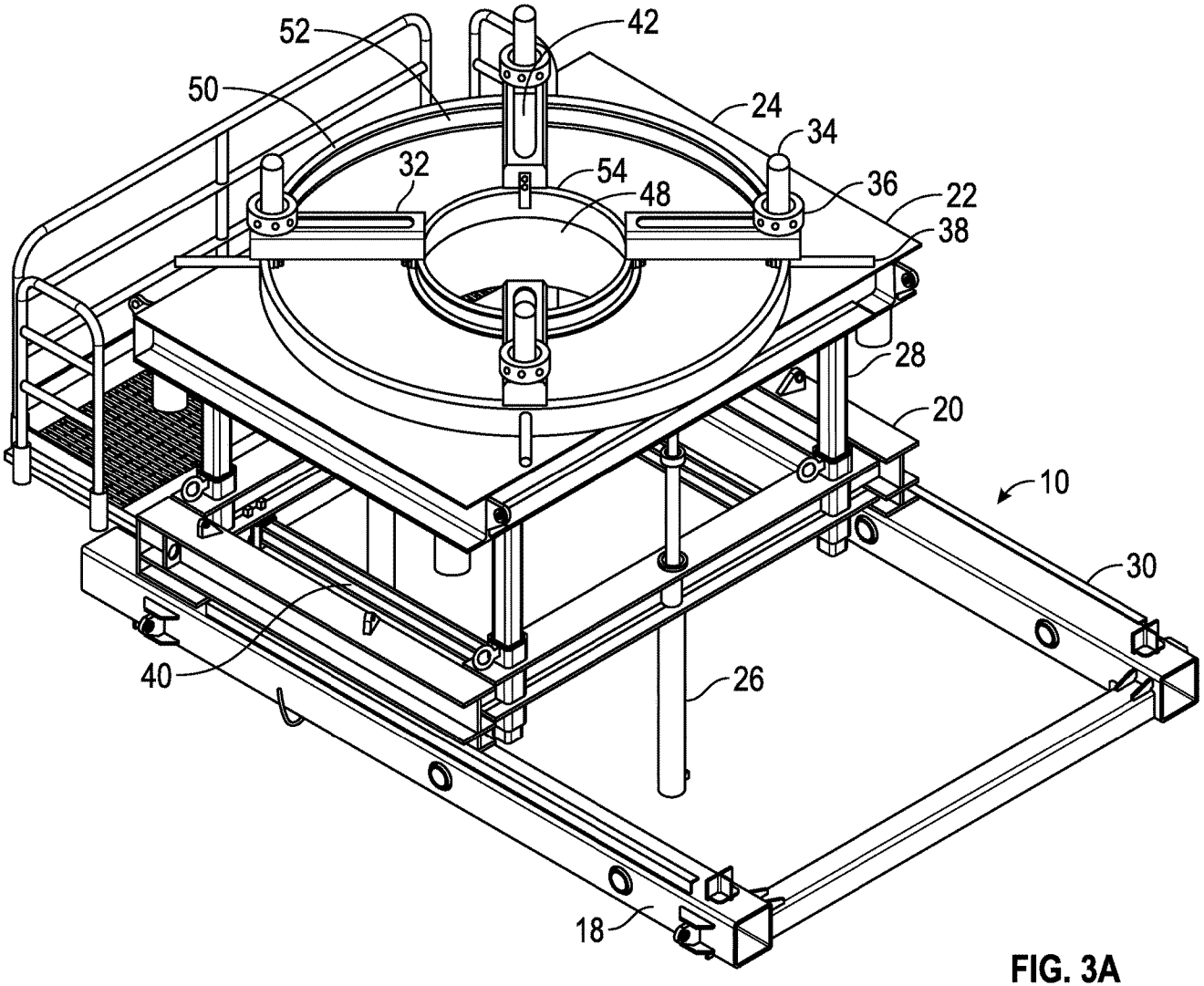
FIG. 3A is a schematic perspective top view of the exemplary injector head system in a first position.
Figure 3B:
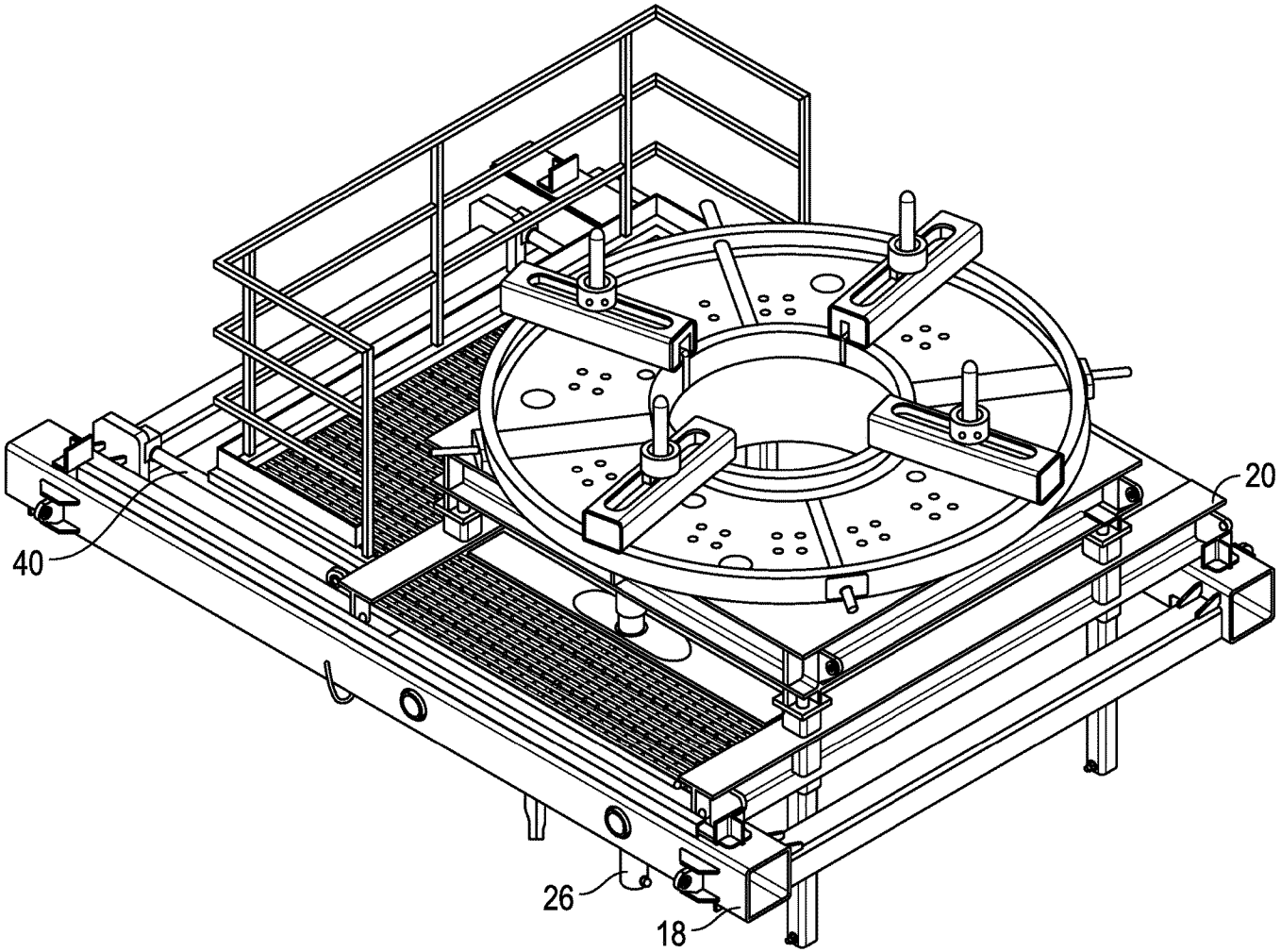
FIG. 3B is a schematic perspective top view of the exemplary injector head system in a second position.

FIG. 3A is a schematic perspective top view of the exemplary injector head system in a first position. FIG. 3B is a schematic perspective top view of the exemplary injector head system in a second position. The universal injector head system 10 can include an injector head platform 20 having an assembly of frame members. The injector head platform 20 can be supported on a support frame 18 that can be coupled to and supported by one or more columns 8 described above. At least one lift 26 can be coupled to the platform. An injector head table 22 can be coupled to the injector head platform 20 and the lift 26 so that the table can be raised and lowered in elevation relative to the platform by the lift. At least one guide 28 can help stabilize the injector head table 22 and maintain alignment with the injector head platform 20. An injector head adapter 24 can be coupled to the injector head table 22. The injector head adapter 24 can include one or more frame members 50, which are shown as a disk-shaped frame for illustrative purposes (although the shape can vary), and a central or otherwise located opening 48. The injector head adapter 24 can include an outer peripheral support 52 and an inner peripheral support 54. The peripheral supports 52, 54 can support one or more locator arms 32, which can be coupled around the surface of the frame member 50 of the injector head adapter 24. A locking pin 34 can be coupled with the locator arm 32, such as in a slot 42 within the locator arm. The locking pin 34 in at least one embodiment can be an inverted "T" shape or other shape, for example, so that the head of the locking pin can be held within the locator arm 32 and the locking pin can extend upwardly through the slot 42. A locking nut 36 can be coupled with the locking pin 32, such as threadably or otherwise, for tightening the locking pin to the locator arm 32 and fixedly or otherwise coupling the locking pin 34 with the slot 42 at one or more locations along the length of the locator arm. In the exemplary embodiment illustrated, which is but one of many, four locator arms 32 are shown, although more or less locator arms can be used (e.g., 1, 2, 3, 5, or more than 5). The locator arms 32, locking pins 34, and locking nuts 36 can couple an injector head to the universal injector head adapter 24 and consequently to the injector head table 22 and remainder of the system 10.

Advantageously, the injector adapter may not need to be removed and exchanged for another adapter to fit another injector head, as can be required with conventional equipment. Instead, one or more injector heads, which can be or include any injector head for a particular application, whether now known or future developed, can be removed from the injector head adapter and one or more other injector heads, such as a differently shaped or sized injector head, can be installed by adjusting the location of at least one of the locking pins without requiring removal of the injector head adapter. Hence, the costs associated with having numerous different injector head adapters on hand can be reduced, as can the time involved with removing and installing or reinstalling a plurality of different adapters to fit different shapes and sizes of injector heads during operations.

To facilitate alignment of the injector head platform 20 to operations from the lift frame 2, the injector head platform 20 can be laterally or otherwise movable relative to the support frame 18 coupled to the lift frame. A platform actuator 40 can be coupled to the support frame 18 and the injector head platform 20, and can be actuated for transversely or otherwise moving the injector head platform. The actuator can be or include, for example, a pneumatic or hydraulic cylinder, a linear actuator, a chain and sprocket drive, a rack and pinion, a screw drive, or other types of drives, separately or in combination, in whole or in part.

Figure 4:
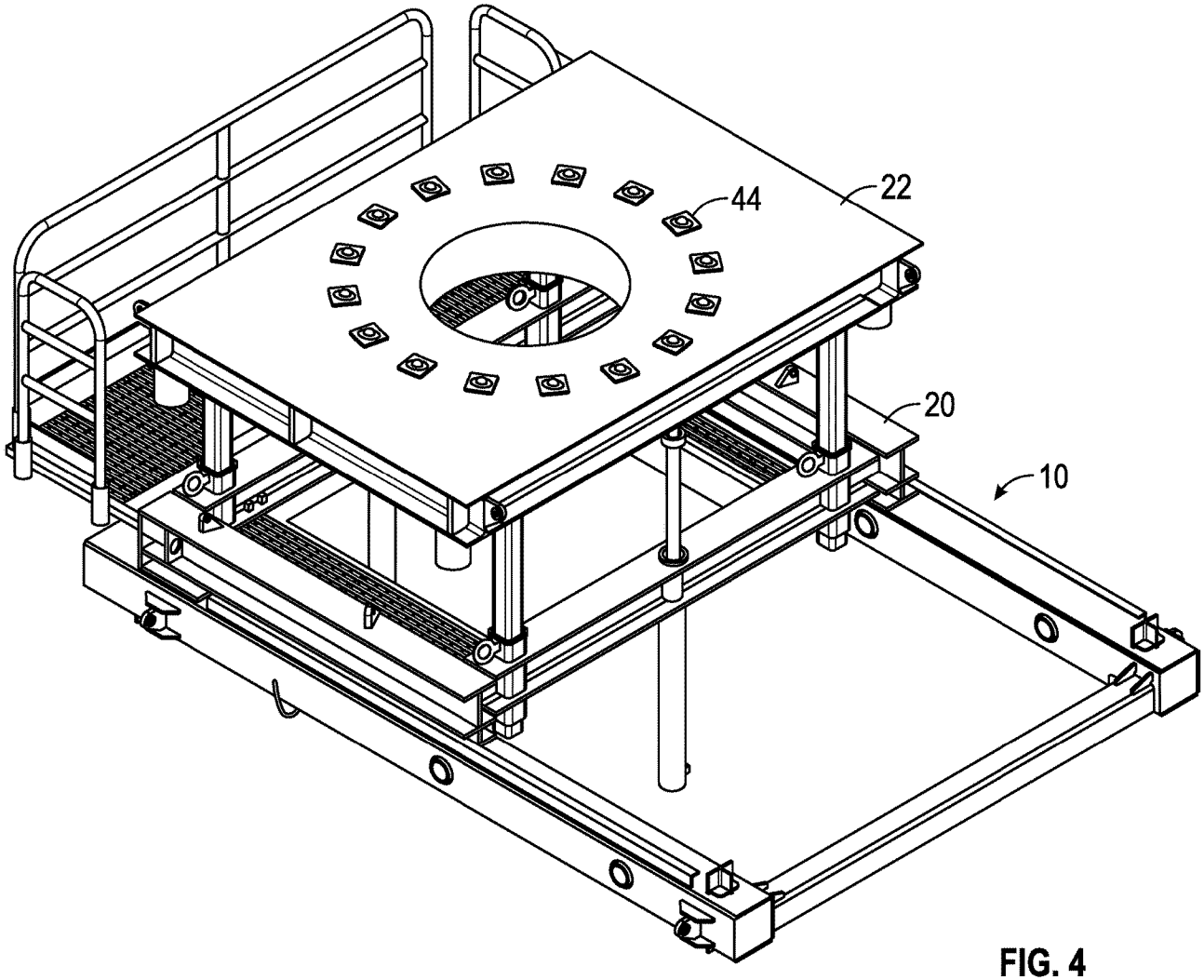
FIG. 4 is a schematic perspective top view of the exemplary injector head system without the adapter and showing rollers disposed between the injector head table and the injector head adapter.

FIG. 4 is a schematic perspective top view of the exemplary injector head system without the adapter and shows rollers disposed between the injector head table and the injector head adapter. One or more rollers 44, which can include a series of rollers 44, can be disposed at least partially between the injector head table 22 and the injector head adapter described above for allowing the adapter to be rotated or otherwise moved relative to one or more other components of the system, which can include being moveable about a central or other axis. The movability of the injector head adapter can enhance the universality of the injector head adapter and otherwise facilitate alignment and coupling with one or more injector heads. In at least one embodiment, the rollers can be spherical ball transfer units that allow movement in any direction, which can include in a planar direction, including when a plurality of units are present, such as when three or more units are used. The use of any number of rollers is possible.

Figure 5A:
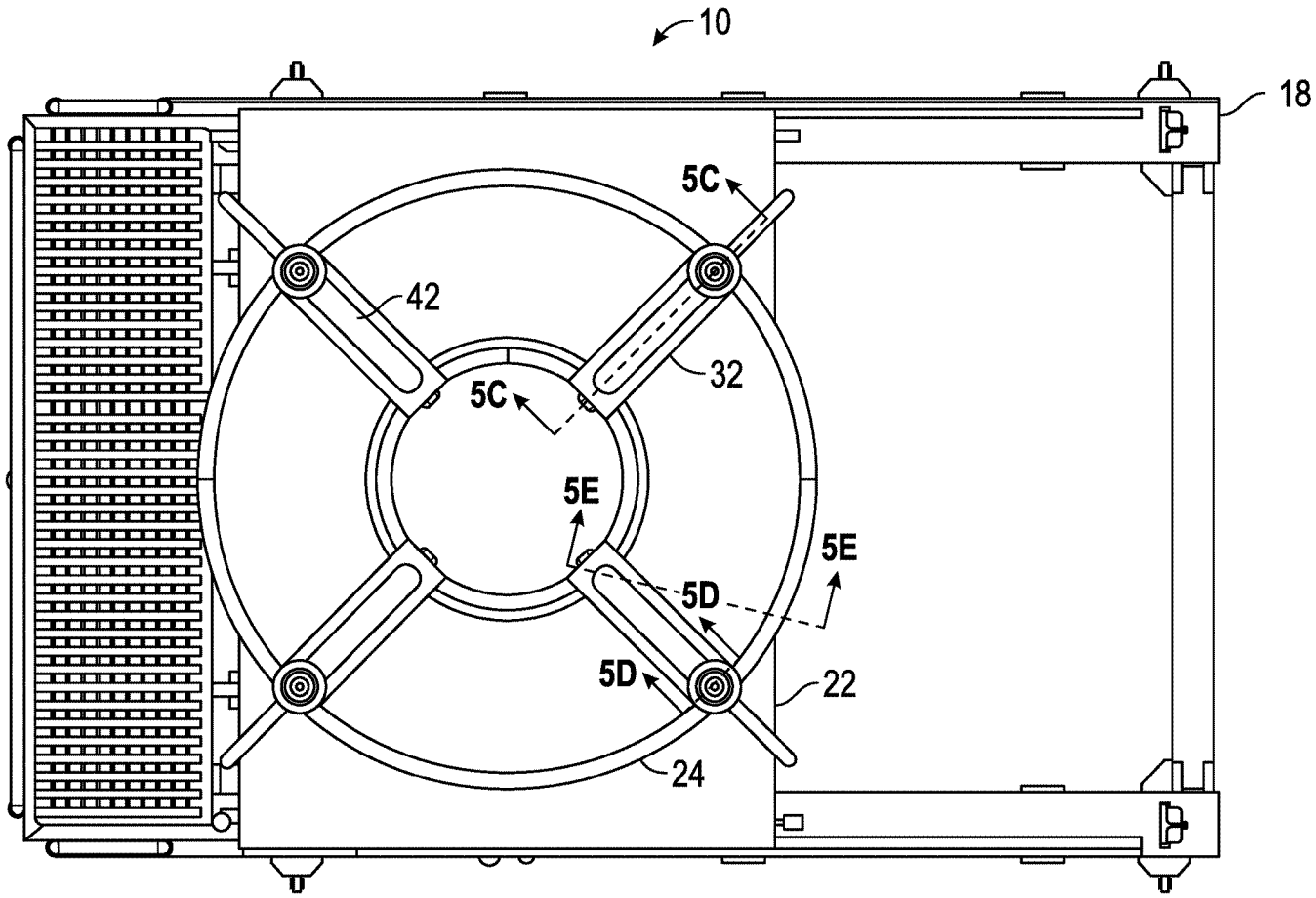
FIG. 5A is a schematic top view of the exemplary injector head system.
Figure 5B:
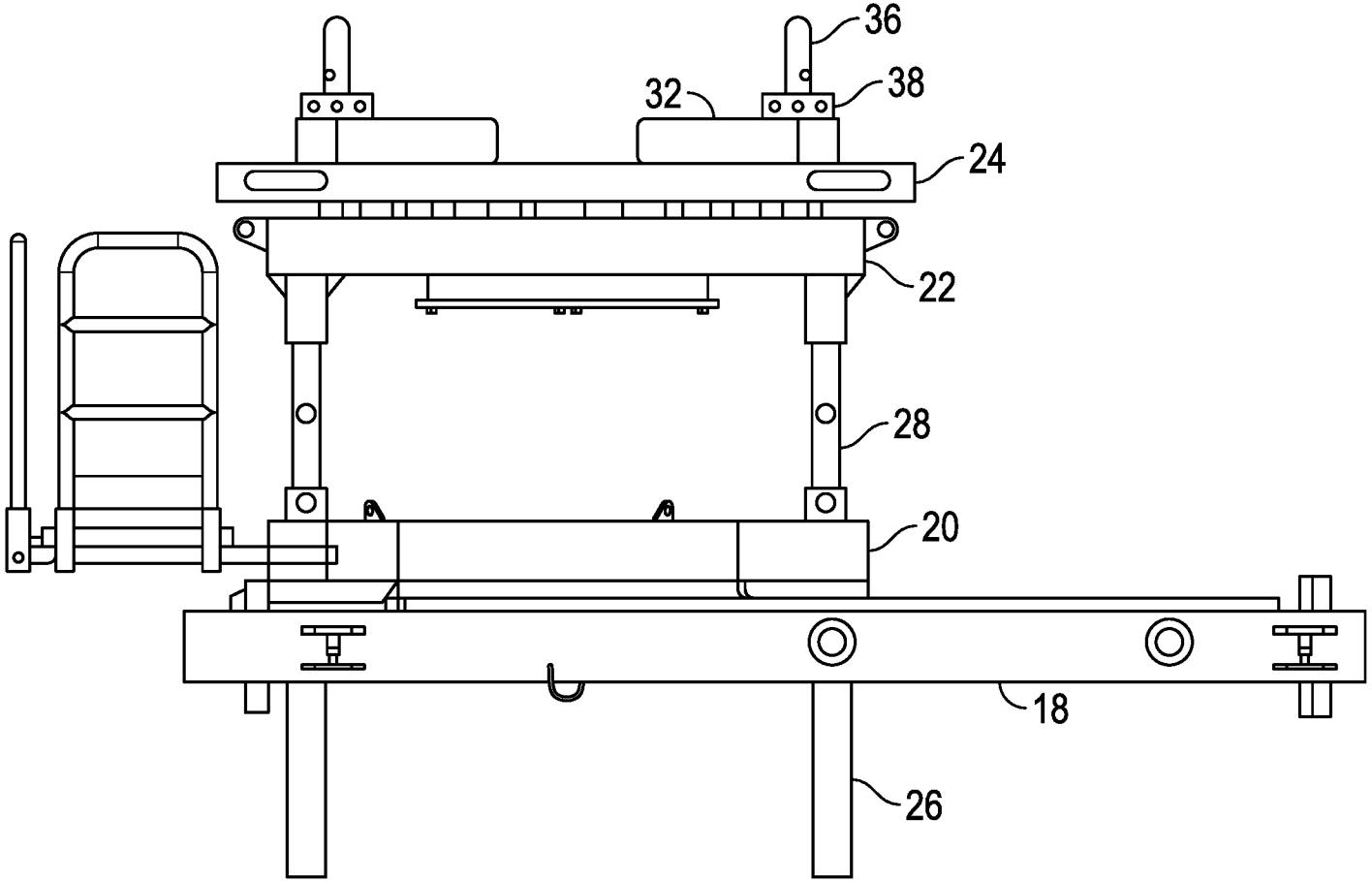
FIG. 5B is a schematic front view of the injector head system of FIG. 5A.
Figure 5C:
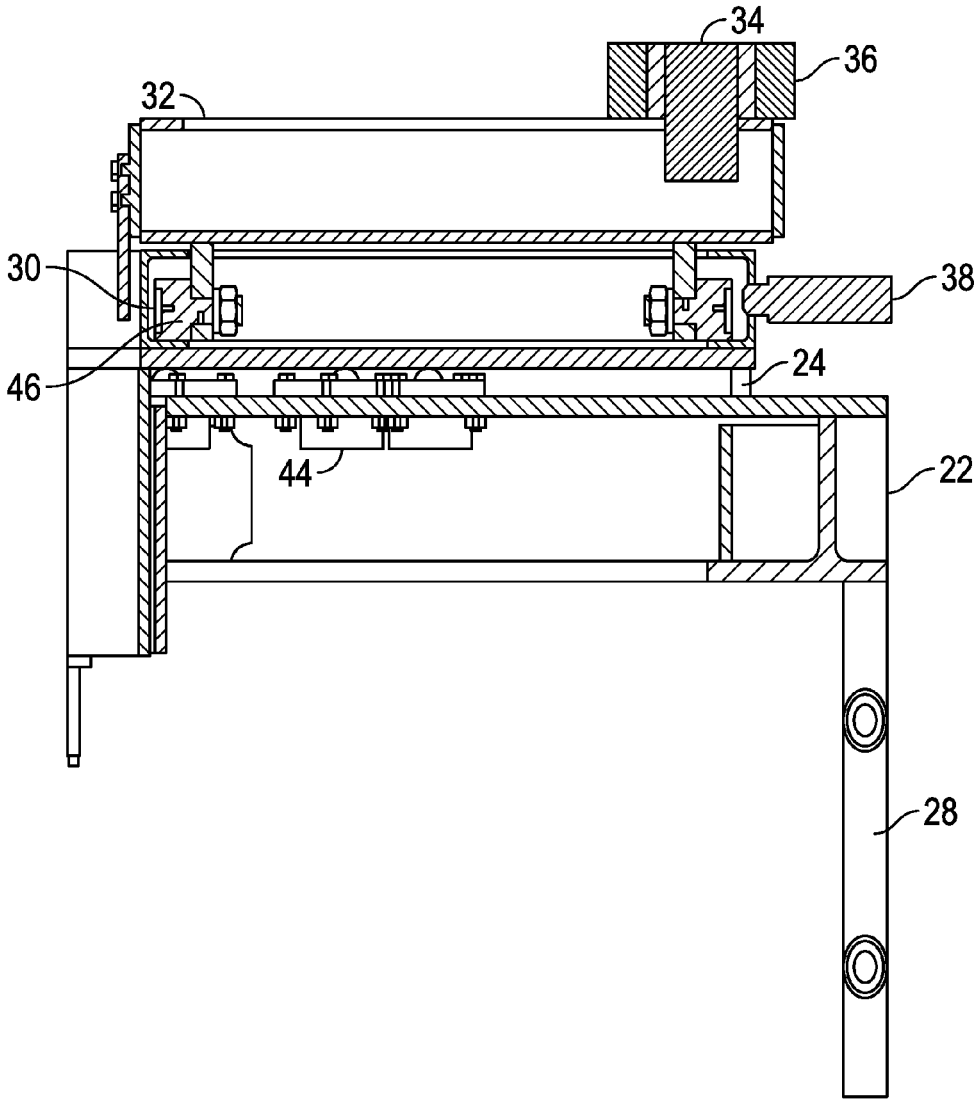
FIG. 5C is a schematic cross sectional side view through a portion of FIG. 5A showing an injector head table, an injector head adapter, and a locator arm with a locking pin and a locking nut.
Figure 5D:
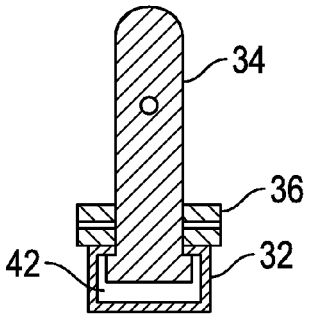
FIG. 5D is a schematic cross sectional end view through a portion of FIG. 5A showing a locator arm with a locking pin and a locking nut.
Figure 5E:
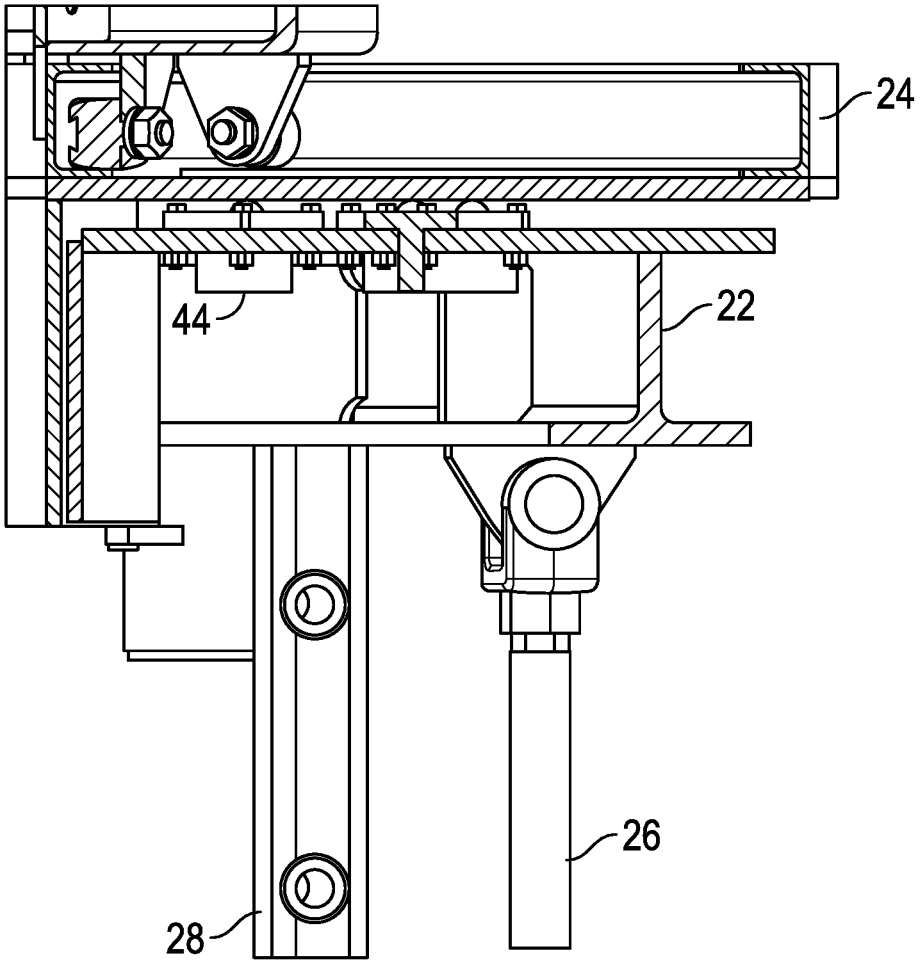
FIG. 5E is a schematic cross sectional side view through a portion of FIG. 5A showing an injector head table, an injector head adapter, and rollers disposed between the table and the adapter.

FIG. 5A is a schematic top view of the exemplary injector head system. FIG. 5B is a schematic front view of the injector head system of FIG. 5A. FIG. 5C is a schematic cross sectional side view through a portion of FIG. 5A showing an injector head table, an injector head adapter, and a locator arm with a locking pin and a locking nut. FIG. 5D is a schematic cross sectional end view through a portion of FIG. 5A showing a locator arm with a locking pin and a locking nut. FIG. 5E is a schematic cross sectional side view through a portion of FIG. 5A showing an injector head table, an injector head adapter, and rollers disposed between the table and the adapter. INAB, the universal injector head system 10 can include the injector head platform 20 supported on the support frame 18. The injector head table 22 can be coupled to the injector head platform 20 and the lift 26, for example, so that the table can be raised and lowered, and alignment can be assisted by at least one guide 28. The injector head adapter 24 can be rotatably coupled with the injector head table 22, which can include rollers disposed at least partially between the injector head table and the injector head adapter. The injector head adapter 24 can include one or more rotating pins 38, which can extend outwardly from the adapter, for assisting with rotation or movement of the adapter on the rollers 44. The locking pin 34 can extend upwardly through or at least partially within the slot 42 in the locator arm 32 on the injector head adapter 24, and can be held in position by one or more couplers, such as a locking nut 36. The locking pins 36 can be adjusted along the slot 42 of the locator arms 32, such as by loosening and tightening the locking nut 38, for fitting or accommodating various sizes or shapes of injector heads. If required or desired for engagement with one or more injector heads, one or more of the locator arms 32 can be adjusted, relocated or otherwise moved on the injector head adapter 24.

Other and further embodiments utilizing one or more aspects of the disclosure described above can be devised without departing from the spirit or scope of Applicants' invention. For example, the shapes and orientations of the components of the injector head systems can vary, and the injector head adapter can include powered rotation, which can be controlled by a computer or other controller. INAB, the injector head adapter may not be rotatable or otherwise movable, and can be in a fixed position.

Further, the various methods and embodiments of the system can be included in combination with each other, in whole or in part, to produce variations of the disclosed methods and embodiments. Discussion of singular elements can include plural elements and vice-versa. References to at least one item can include one or more items. Also, various aspects of the embodiments can be used in conjunction with each other to accomplish the goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The components and systems can be used in a number of directions and orientations. The terms "coupled," "coupling," "coupler," and the like are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling can occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The disclosure has been described in the context of preferred and other embodiments and not every embodiment of the disclosure has been described. Obvious modifications and alterations to the described embodiments are available to those of ordinary skill in the art having the benefits of the present disclosure. The disclosed and undisclosed embodiments are not intended to limit or restrict the scope or applicability of the inventions conceived of by the Applicants, but rather, in conformity with the patent laws, Applicants intend to protect fully all such modifications and improvements that come within the scope or range of equivalents of the following claims.

What is claimed is:

1. An injector head system, comprising:

an injector head platform having an assembly of frame members and at least one lift coupled to the platform;

an injector head table coupled to the injector head platform and the lift, the table being movable in elevation relative to the platform by the lift; and an injector head adapter coupled to the injector head table, the injector head adapter comprising a frame member;

an opening in the frame member;

at least one locator arm coupled to the frame member, the locator arm having a slot formed in a surface of the locator arm;

a pin engaged with the slot; and a lock nut coupled with the pin;

wherein the pin is configured to be optionally fixed at one or more positions in the slot of the locator arm.

2. The system of claim 1, further comprising a plurality of rollers disposed at least partially between the injector head table and the injector head adapter, wherein the injector head adapter is configured to rotate on the plurality of rollers relative to the injector head table.

3. The system of claim 1, further comprising at least one guide slideably coupled to the injector head platform and the injector head table.

4. The system of claim 1, further comprising a frame configured to support the injector head platform.

5. The system of claim 4, further comprising at least one actuator coupled to the frame and the injector head platform and configured to move the injector head platform laterally relative to the frame.

6. The system of claim 1, wherein the at least one locator arm comprises a plurality of locator arms coupled to the frame member, each locator arm having a slot formed in a surface thereof, further comprising:

a plurality of pins, a pin engaged in the slot of each locator arm; and a plurality of lock nuts, a lock nut coupled with each pin;

wherein each pin is configured to be optionally fixed at one or more positions in the slot with which each pin is engaged.

7. The system of claim 6, wherein each of the plurality of locator arms extends radially outwardly from the opening in the frame member.

8. The system of claim 7, wherein each of the plurality of pins is configured to be optionally fixed to the locator arm to which each pin is coupled in a plurality of different locations, each location being a different distance from the opening in the frame member.

9. The system of claim 8, wherein each of the plurality of pins has a head disposed at least partially within the locator arm to which the pin is coupled, and wherein the lock nut coupled to each pin is disposed at least partially above the slot in the locator arm.

10. A method of coupling an injector head to an injector head system, the system comprising an injector head platform, an injector head table supported above the injector head platform, a lift coupled to the injector head platform and the injector head table, an injector head adapter coupled to the injector head table, at least one locator arm coupled to the injector head adapter, a pin coupled to each locator arm, and a lock nut coupled to each pin, the method comprising:

rotating the injector head adapter relative to the injector head to align the injector head adapter with the injector head, the at least one locator arm including a first locator arm;

moving a first pin relative to the first locator arm and aligning the first pin with the injector head;

coupling the first pin in a first position on the first locator arm with a first lock nut; and coupling the injector head to the injector head adapter.

11. The method of claim 10, further comprising removing the injector head from the injector head adapter, moving the first pin relative to the first locator arm and aligning the first pin with a second injector head, coupling a second pin in a second position on the first locator arm with the first lock nut, and coupling the second injector head to the injector head adapter.

12. The method of claim 10, further comprising elevating the injector head table above the injector head platform with the lift.

13. The method of claim 10, further comprising moving the first pin radially inwardly or outwardly relative to a central opening in the injector head adapter.

14. The method of claim 10, wherein the at least one locator arm comprises a plurality of locator arms, further comprising moving a plurality of pins relative to the plurality of locator arms, aligning each pin with the injector head, and coupling each pin in a first position on its corresponding locator arm.

15. An injector head adapter, comprising:

a frame member adapted to couple to an injector head table;

an opening through the frame member;

a plurality of locator arms coupled to the frame member, each locator arm having a slot along a length thereof and extending radially outwardly from the opening through the frame member;

a plurality of pins comprising a pin engaged with the slot of each locator arm, each of the pins having a head disposed at least partially within a corresponding locator arm of each pin and a body extending upwardly therefrom; and a plurality of lock nuts comprising a lock nut coupled with each of the plurality of pins;

wherein each of the plurality of pins is configured to be optionally fixed at a plurality of positions in the slot of a corresponding locator arm of each pin.

16. The injector head adapter of claim 15, wherein each of the plurality of positions is a different distance from the opening through the frame member.

17. The injector head adapter of claim 15, wherein each of the plurality of lock nuts is coupled to the body of a corresponding pin of each locknut and disposed at least partially above its corresponding locator arm.

* * * * *